US011358756B2

(12) United States Patent
Bosetti et al.

(10) Patent No.: US 11,358,756 B2
(45) Date of Patent: Jun. 14, 2022

(54) PRESS-ON CAPS AND SEALED CONTAINERS COMPRISING THE PRESS-ON CAPS

(71) Applicant: Goglio S.p.A., Milan (IT)

(72) Inventors: Osvaldo Bosetti, Milan (IT); Giuseppe Gullo, Milan (IT)

(73) Assignee: GOGLIO S.p.A., Milan (IT)

( * ) Notice: Subject to any disclaimer, the term of this patent is extended or adjusted under 35 U.S.C. 154(b) by 64 days.

(21) Appl. No.: 16/608,373

(22) PCT Filed: Apr. 27, 2018

(86) PCT No.: PCT/IB2018/052926
§ 371 (c)(1),
(2) Date: Oct. 25, 2019

(87) PCT Pub. No.: WO2018/203193
PCT Pub. Date: Nov. 8, 2018

(65) Prior Publication Data

US 2021/0094732 A1 Apr. 1, 2021

(30) Foreign Application Priority Data

May 2, 2017 (IT) ..... 102017000047199

(51) Int. Cl.
*B65D 39/00* (2006.01)
*B65B 7/28* (2006.01)

(52) U.S. Cl.
CPC ..... *B65D 39/0023* (2013.01); *B65B 7/2821* (2013.01); *B65D 2539/001* (2013.01)

(58) Field of Classification Search
CPC ..... B65D 39/0023; B65D 2539/001; B65D 2539/003; B65B 7/2821; B67B 1/04
See application file for complete search history.

(56) References Cited

U.S. PATENT DOCUMENTS 1,931,595 A * 10/1933 Weguclin ..... B65D 39/02 215/298
3,297,193 A * 1/1967 Stevens, Jr. ..... B65D 41/023 220/782
3,888,065 A * 6/1975 Heisler ..... B65B 7/2821 53/489

(Continued)

OTHER PUBLICATIONS

Teixeira, Antonio (EP Authorized Officer), International Search Report and Written Opinion of the International Searching Authority, dated Jul. 5, 2018, in corresponding International Application No. PCT/IB2018/052926, 14 pages.

*Primary Examiner* — Nathaniel C Chukwurah
*Assistant Examiner* — Lucas E. A. Palmer
(74) *Attorney, Agent, or Firm* — MH2 Technology Law Group LLP

(57) ABSTRACT

A system for capping a mouth of a container may include: a press-on cap for irreversibly capping the mouth of the container, wherein the press-on cap is made of polymeric material able to withstand high-temperature sterilization and wherein the press-on cap may include: a tubular sleeve extending along an axis of extension and configured to be irreversibly locked to the mouth of the container; a rim that radially projects out of the tubular sleeve at an end of the press-on cap; a capping wall oriented transverse to the tubular sleeve and extending from the rim over a front surface delimited by the rim, wherein the front surface faces outwardly; and a plurality of protrusions, which extend out of the front surface. The front surface may have a height variation relative to the rim across the front surface ranging from −1% to 1% of a characteristic dimension of the capping wall.

20 Claims, 5 Drawing Sheets

(56) References Cited

U.S. PATENT DOCUMENTS 4,872,572 A * 10/1989 Schrooten ..... B65D 39/0023 215/307
4,916,885 A * 4/1990 Loliger ..... B65B 55/022 53/570
5,479,955 A * 1/1996 Roodvoets ..... B65B 55/022 137/15.16
5,817,082 A * 10/1998 Niedospial, Jr ..... B65D 51/227 604/414
5,845,797 A * 12/1998 Sudo ..... B65D 39/0011 215/247
2002/0023893 A1* 2/2002 Sudo ..... B65D 39/16 215/355
2003/0030233 A1* 2/2003 Benzinger ..... B65D 51/1616 277/628
2008/0237235 A1* 10/2008 Morabito ..... B65D 39/08 220/288
2009/0152279 A1* 6/2009 Burns ..... B01F 15/00681 220/592.16
2010/0059519 A1 3/2010 Brozell et al.
2010/0206836 A1* 8/2010 Koshidaka ..... B65D 39/0023 215/355
2011/0290754 A1 12/2011 Taber et al.
2012/0285121 A1* 11/2012 Airaksinen ..... B44D 3/127 53/287
2013/0270271 A1* 10/2013 Asai ..... B65D 39/007 220/277
2013/0318915 A1* 12/2013 Iskarous ..... G01N 35/04 53/264
2014/0345233 A1* 11/2014 Parisini ..... B65B 39/12 53/426
2017/0081056 A1* 3/2017 Zambaux ..... B65B 7/2821
2017/0081060 A1* 3/2017 van der Meijden .. B65B 55/027
2017/0152130 A1* 6/2017 Kakuda ..... B01L 3/50825
2017/0326031 A1* 11/2017 Masuyama ..... B29C 43/184
2018/0134457 A1* 5/2018 Mutterle ..... B65D 41/62

* cited by examiner

Sez. I-I

PRESS-ON CAPS AND SEALED CONTAINERS COMPRISING THE PRESS-ON CAPS

CROSS-REFERENCE TO RELATED APPLICATION(S)

This application is a national stage entry from International Application No. PCT/IB2018/052926, filed on Apr. 27, 2018, in the Receiving Office ("RO/IB") of the International Bureau of the World Intellectual Property Organization ("WIPO"), and published as International Publication No. WO 2018/203193 A1 on Nov. 8, 2018; International Application No. PCT/IB2018/052926 claims priority from Italian Patent Application No. 102017000047199, filed on May 2, 2017, in the Italian Patent and Trademark Office ("IPTO"), the entire contents of all of which are incorporated herein by reference.

FIELD OF THE INVENTION

The present invention relates to a press-on cap and a hermetically-sealable container having such press-on cap, particularly a press-on cap of the irreversible type, as defined in the preamble of claim 1.

Background Art

Press-on caps are known in the art to be used for hermetically sealable containers or bags and to be formed with multilayer or polylaminate films.

The hermetically sealable containers are embodied as flexible, semi-rigid or rigid containers, and usually have a volume that indicatively ranges from a few tens of liters and a few hundreds of liters.

Generally, these containers are filled using appropriate filling apparatus that can be mechanically coupled to the neck of the container to fill the latter with the product, and later close it using the aforementioned press-on cap.

Press-on caps are configured to be associated with the neck of the container to cap the container once a product, preferably a food product, such as tomato-based products, fruit juices, vegetable soups, dairy products, creams, or the like, has been introduced therein.

Namely, the press-on caps designed to be used with such containers are suitable for irreversible capping of the container, i.e. such that it cannot be uncapped or opened without using special tools that cause it to be permanently deformed once it has been opened.

The containers so capped may be also stored outdoors for long time periods, with no risk of losing/altering the integrity of the product contained therein.

For example, also referring to FIGS. 1A and 1B, which show a press-on cap adapted to be closingly associated with the mouth of a neck of a hermetically sealable container, the press-on cap 1 is shown as comprising a tubular sleeve 2 which extends along an axis of extension X-X and has a cavity 3 that ends with a dome-shaped bottom 4.

The tubular sleeve 2 has a shoulder 5 which radially projects out of the tubular sleeve 2 and is engaged with the inner wall of the neck to ensure irreversible opening once the cap 1 has been closingly placed on the mouth.

The tubular sleeve 2 comprises a plurality of sealing rings 6, which radially project out of the sleeve 2, and are also engaged with the inner surface of the neck to ensure reversible closing, i.e. allowing reopening and/or reclosing, as described herein below.

It shall be noted that the thickness of the dome may differ by ±2 mm from the thickness of the tubular sleeve 2, such that the combination of the shoulder 5, the thickness of the dome and the shape of the bottom 4 will oppose a resistance of the order of a few hundreds to about one thousand Newton to the forces applied to the cap to remove it from the container.

If the removal forces exceed a predetermined limit, the neck of the container is designed to be deformed and prevent the container from being closed with the cap again.

The press-on cap also has a rim 7 at one free end thereof, i.e. its top end, which is external to the container when the cap is closingly associated with the container, the rim radially projecting out of tubular sleeve 2, This rim 7 is configured to be gripped by the filling apparatus and be arranged to allow the dispensing head to dispense the product and to be later capped with the press-on cap.

Once capping has been completed, it may happen that some product will fall from the dispensing head to the bottom 4 of the cap 1.

It will be understood that while the excess food product that falls from the dispensing head to the bottom of the cap 1 does not affect the integrity of the product in the container, it may still cause generation of molds and microbial growth, leading to obvious and imaginable consequences, in terms of both hygiene and appearance.

This problem is even more acute when the product in the container has a low acidity degree and is thus more exposed to microbial contamination.

In order to prevent product accumulation in the cavity, the cap 1 and the neck of the container are washed and/or sterilized using sanitizing agents, assisting preservation of the sterility of the container both at the end of the production cycle and at the end of the filling operation.

Nevertheless, the washing and/or sterilization process is not always effective, due to the shape of the cap 1.

Such shape hinders surface cleaning, as the cavity 3 acts as a receptacle.

Namely, the cavity 3 has a flat surface 3A and a side wall 3B extending in an orthogonal direction relative to the longitudinal direction of extension of the flat surface 3A. The side wall 3B ends with a corner radius 3C, to be connected to the free edge of the cap.

It shall be noted that washing and/or sterilization are not effective also due to the chemico-physical characteristics of the packaged product, such as the acidity degree, or due to the type of material that has been used to form the cap, because not all the polymeric materials that are used to form caps are stable when high-temperature steam (e.g. at temperatures exceeding 140° C.) or sanitizing agents impinge thereupon.

As a result, caps should be manufactured with different material characteristics according to the chemico-physical properties of the product to be stored in the container, which leads to obvious cost increase both for manufacturers of press-on caps and/or containers and for users.

Documents U.S. Pat. No. 3,297,193, US 2011/290754 and US 2002/023893 show press-on caps for containers or bags in accordance with the pre-characterizing portion of claim 1.

Technical Problem

It will be understood from the foregoing that a need is felt by manufacturers of hermetically sealable containers or bags with non-reopenable or irreversible press-on caps to obviate the problem of high-temperature resistance and safe product filling, even with low-acidity products.

Therefore, the present invention is based on the problem of providing a press-on cap and an associated hermetically sealable container that can contain products having chemico-physical characteristics ranging from strongly basing to strongly acid without making changes to the apparatus designed to dispense the product, close the container, and wash and sterilize the latter.

A further object of the present invention is to provide a press-on cap and an associated hermetically sealable container that can afford more hygienic, safer filling.

Technical Solution

This problem is solved by press-on cap as defined by the features of claim 1.

The problem is also solved by a hermetically sealable container having a press-on cap as defined by the features of claim 13.

Advantageous Effects

The present invention can provide a non-reopenable press-on cap that can be more easily cleaned from residues and is made from a sterilization-stable material.

Furthermore, the present invention can provide a cap that can be easily used with existing filling apparatuses, which means that the cap is compatible with current filling apparatuses without requiring substantial changes to such filling apparatuses.

BRIEF DESCRIPTION OF THE DRAWINGS

Further features and advantages of the present invention will result from the following description of one preferred embodiment thereof, which is given by way of illustration and without limitation with reference to the accompanying figures, in which.

DETAILED DESCRIPTION

Figure 1A:
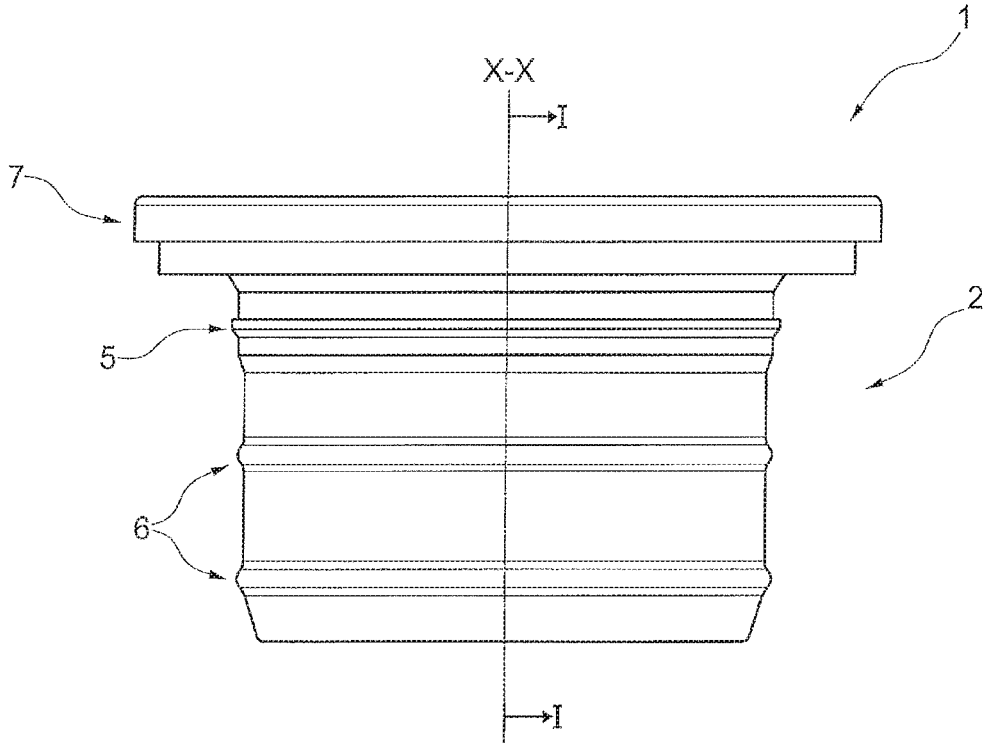
Fig. 1A Prior Art
FIGS. 1A and 1B show a prior art press-on cap in a lateral view and a sectional view as taken along line I-I respectively.
Figure 1B:
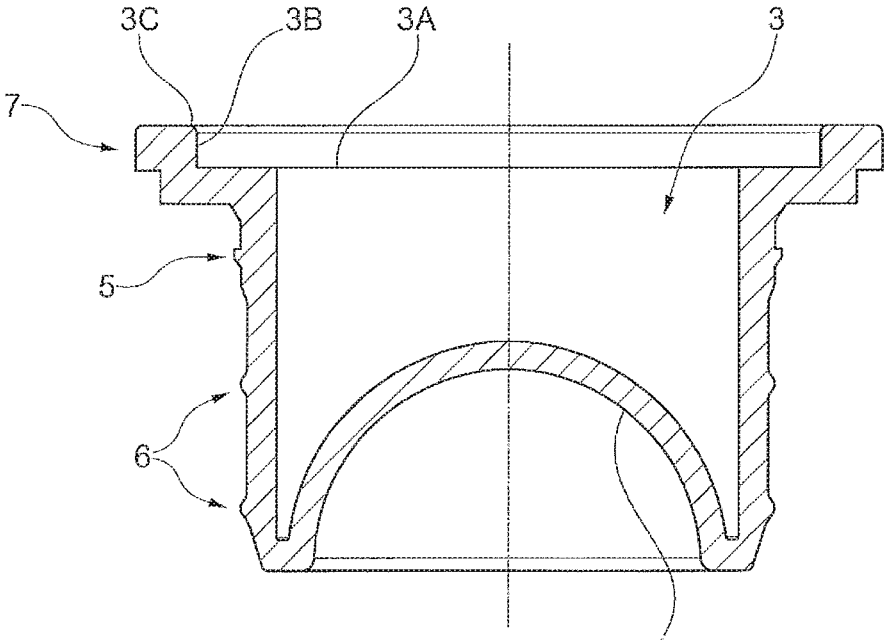
Fig. 1B Prior Art
Figure 2A:
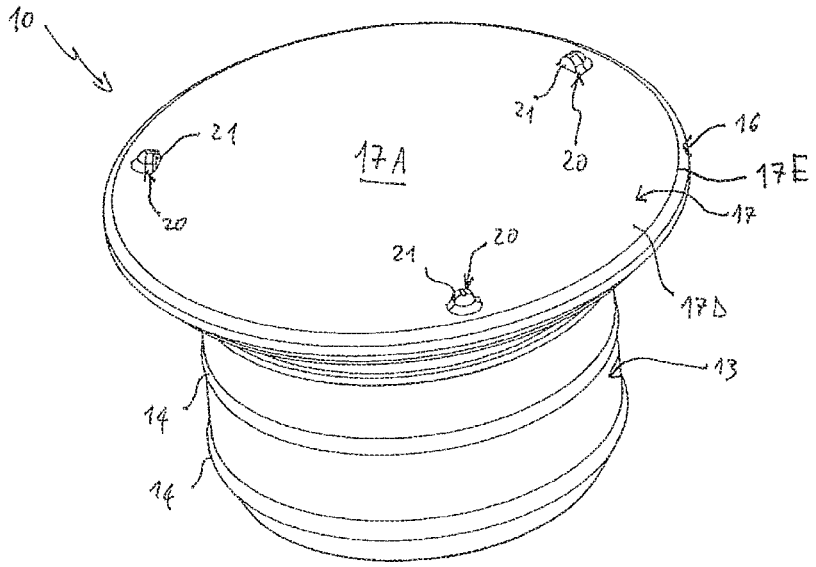
FIGS. 2*a* and 2*b* show a first embodiment of a press-on cap of the present invention in a top perspective view and a lateral sectional view respectively.
Figure 2B:
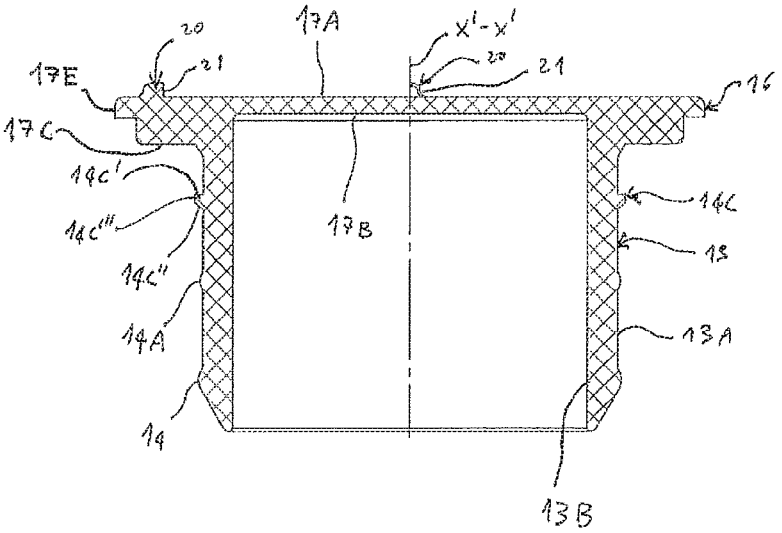

The accompanying figures show a press-on cap 10 which is designed to be irreversibly associated with a neck (or spout) 12 of a hermetically sealable container or bag 11 after a container-filling step. This cap 10 is preferably formed with a multilayer or polylaminate film.

The hermetically sealable container 11 may be of flexible, rigid or semi-rigid type and, once it has been capped, it can maintain the product stored therein in aseptic conditions.

The hermetically sealable container or bag 11 is manufactured using well-known techniques and will not be further described hereinbelow.

The neck 12 of the container 11 extends along an axis of extension X'-X' and defines an inlet mouth or opening through which the product, which is preferably a food product such as tomato, carrot, papaya, mango, banana, or apple puree, milk, eggs, dairy products or pharmaceutical products.

For this purpose, a special filling apparatus (not shown), having amongst other things a dispensing head, is used.

The press-on cap 10 has a tubular sleeve 13 which extends along an axis of extension X'-X'. This tubular sleeve 13 is designed to be unremovably fixed to the mouth of the container 11.

It shall be noted that the axis of extension X'-X' of the press-on cap 10 coincides with the axis of extension of the neck 12 of the container 11 when the press-on cap 10 is closingly associated with the mouth of the neck, which means that they are coaxial.

A rim 16 that radially projects out of the tubular sleeve 13 is situated at one end of the press-on cap 10.

It shall be noted that the end of the press-on cap 10 that comprises the rim 16 is the end that remains outside the container 11, once the cap 10 has been associated with the neck 12.

In other words, the rim 16 constitutes the upper end of the press-on cap 10 that is external to the container when the cap 10 is closingly associated with the mouth of the container.

In one aspect the rim 16 has a shape that allows it to be engaged by the filling apparatus.

Particularly, the rim 16 of the press-on cap is suitably sized to be readily used with commercially available filling apparatuses, thereby affording seamless operation with no need for substantial changes to such filling apparatuses.

This leads to considerable savings and advantages for manufacturers, e.g. for food manufacturers.

It shall be noted that the tubular sleeve 13 defines an outer surface 13A and an inner surface 13B and has a shoulder 14C on its outer surface 13A.

This shoulder 14C is configured to abuttingly engage with an inner surface 12A of the neck 12 of the container 11, to thereby irreversibly seal the mouth, such that it cannot be reopened.

The shoulder 14C simply consists of a change in the diameter of the tubular sleeve 13, which has the purpose of locking the cap in the direction of the axis X'-X'.

In order to abut the neck 12, the shoulder 14C comprises:

- a first portion 14C' which extends in a direction orthogonal to the axis of extension X'-X',
- a second portion 14C" which extends transverse to the axis of extension X'-X' and
- a third portion 14C", which connects the first portion 14C' with the second portion 14C", the third portion 14C'" extending in a direction parallel to the axis of extension X'-X'.

It shall be noted that the first portion 14C' of the shoulder 14C is the portion designed for engagement with the inner surface 12A of the neck 12, to lock the cap in the direction of the axis X'-X'.

In one aspect, prior to product filling, the hermetically sealable container 11 is reversibly capped, i.e. such that the cap 10 may be removed without causing irreparable damage to the neck 12 of the container 11.

For this purpose, a plurality of sealing projections 14 and 14A radially out of the tubular sleeve 13 and have a chamfered or curved profile at their free ends.

Figure 5:
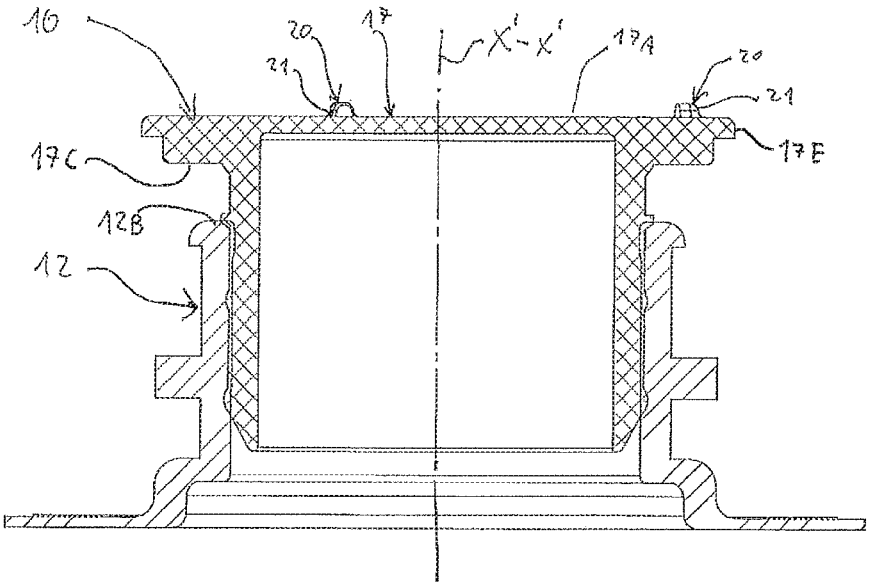
FIG. 5 shows a partially sectional lateral view of the neck of a container associated with the cap of FIGS. 2*a* and 2*b* when the cap is in a reversible closed position.
Figure 6:
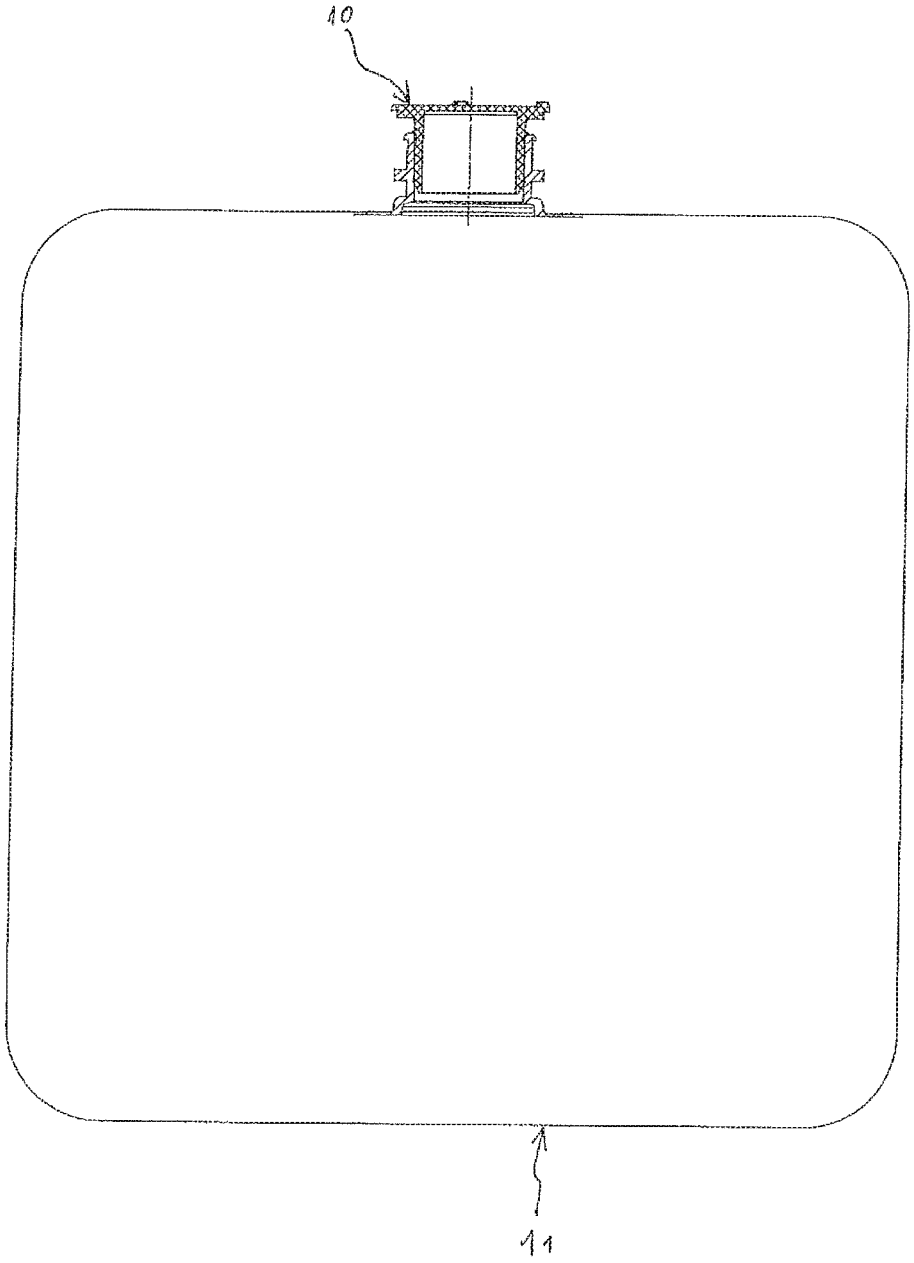
FIG. 6 shows a container having the cap of FIGS. 2*a* and 2*b*.

These sealing projections 14 and 14A engage with the inner surface 12A of the neck 12, for reversible capping of the mouth of the container 11 as shown for example in FIG. 5. Thus, the chamfered profile will allow the cap 10 to be removed by applying forces of the order of three hundred Newton.

Namely, as the mouth of the hermetically sealable container 11 is capped for the first time, the sealing projections 14 and 14A abut the inner surface 12A of the neck 12 and cause such surface to be deformed.

Once the container 11 has been filled with the product, the press-on cap 10 is fitted into the neck 12 until the shoulder 14C abuts the inner surface 12A of the neck 12 to irreversibly deform it and stick thereto.

Here, the annular sealing projections 14 and 14A reach "untouched" areas of the inner surface 12A of the neck 12 (i.e., in areas other than those they had deformed during first capping) to engage therewith.

The press-on cap 10 comprises a capping wall 17 that extends from the rim 16 across the surface delimited by such rim 16 to cap the mouth of the neck 12 of the container 11. The aforementioned tubular sleeve 13 is oriented transverse to the capping wall 17.

Particularly, the capping wall 17 extends transverse to the axis of extension X'-X' to form the ceiling of the press-on cap 10.

The capping wall 17 has a height variation relative to the rim 16 across its surface that ranges from −1% to 1% of a characteristic dimension thereof. In the embodiments as shown in FIGS. 2*a*, 2*b*, 3*a*, and 3*b*, the capping wall 17 has a circular plan shape. Here, the characteristic dimension is defined by the diameter of the capping wall 17. In the embodiment of FIG. 4, the capping wall 17 has a square plan shape. Here, the characteristic dimension is defined by the length of the side of the capping wall 17. In alternative embodiments, not shown, the capping wall 17 may have any plan shape. The characteristic dimensions will be thus defined for each shape as appropriate.

Advantageously, the capping wall 17 is configured to prevent the formation of food deposits. In other words, the capping wall 17 is free of any recess in which food deposits may build up.

For this purpose, the capping wall 17 is formed with a substantially smooth surface. In other words, the capping wall 17 has no notches or recesses.

In one aspect, the wall 17 comprises a front surface 17A and a lower surface 17B, where the front surface 17A is the surface that faces out of the container 11 when the press-on cap 10 is in the closing position whereas the lower surface 17B is the surface that faces the volume defined in the container when the press-on cap 10 is in the closing position.

The capping wall 17 also has an abutment surface 17C, opposite to the front surface 17A and separated from the lower surface 17B by the tubular sleeve 13. This abutment surface 17C has a substantially annular shape and is adapted to abut an upper edge 12B of the neck 12 when the press-on cap 10 is in its irreversible closing position. This advantageously prevents the formation of contaminating deposits between the press-on cap 10 and the neck 12.

Preferably the front surface 17A of the capping wall 17, is the recess-free surface.

It will be appreciated that, since the capping wall 17 has no recesses, residues may be more effectively washed out, as the front surface 17A of the wall 17 has no areas that might act as receptacles for the food product accidentally spilled out of the dispensing head and accumulated on the capping wall 17.

In the illustrated embodiments, the capping wall 17 is substantially flat. In other words, the capping wall 17 is oriented orthogonal to the axis of extension X'-X'.

In alternative embodiments, not shown, the capping wall 17, and particularly the front surface 17A, may have a slightly concave shape. In this case, the bottom of the front surface 17A, substantially located level with the axis of extension X'-X' is lower than the rim 16 by 1% the characteristic dimension of capping wall 17.

Likewise, the capping wall 17, and particularly the front surface 17A, may have a slightly convex shape. In this case, the top of the front surface 17A, substantially located level with the axis of extension X'-X' is higher than the rim 16 by 1% the characteristic dimension of capping wall 17.

It will be appreciated that such a concave or convex shape of the capping wall 17 and/or the presence of an inclined plane ensure that the front surface 17A will be washed even when the water and/or steam used for this purpose have a low pressure.

Here, the concave or convex profile of the capping wall 17 is preferably symmetric with respect to the axis of extension, and the tubular sleeve 13 and the radially projecting rim 16 are symmetric and coaxial with respect to the axis of extension X'-X'.

The cap also comprises alignment means 20 placed on capping wall 17. These alignment means 20 are configured to guide a grip head (not shown) of a filling apparatus during application of the cap to the aforementioned container 11. Particularly, the grip head may be specially shaped to be coupled with the alignment means 20 during application of the cap. Thus, the grip head is able to ensure uniform force distribution over the capping wall 17, for the cap to be optimally fitted onto the container 11.

More in detail, the alignment means 20 comprise a plurality of protrusions 21 that project from the capping wall 17, particularly from the front surface 17A. Preferably, the alignment means 20 comprise three protrusions 21.

The protrusions 21 are particularly arranged in a periphery 17D of the capping wall 17. Furthermore, the protrusions 21 are equally angularly spaced with respect to the axis of extension X'-X'. Also, the protrusions 21 are at equal distances from the axis of extension X'-X'.

Figure 3A:
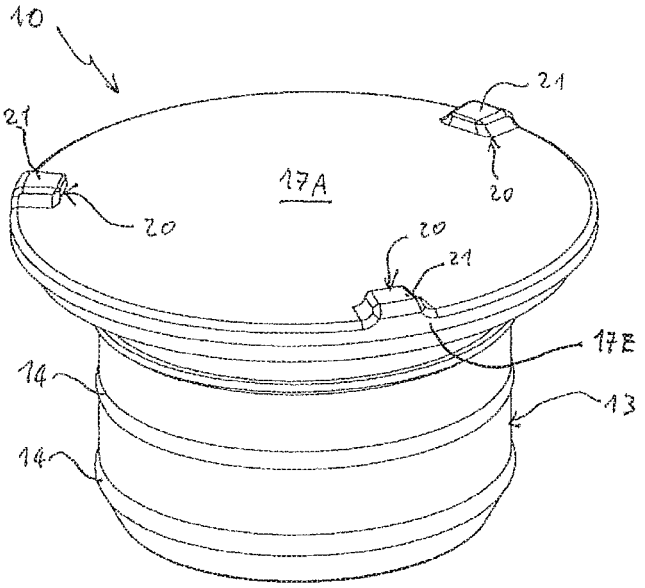
FIGS. 3*a* and 3*b* show a second embodiment of a press-on cap in a top perspective view and a lateral section view respectively.
Figure 3B:
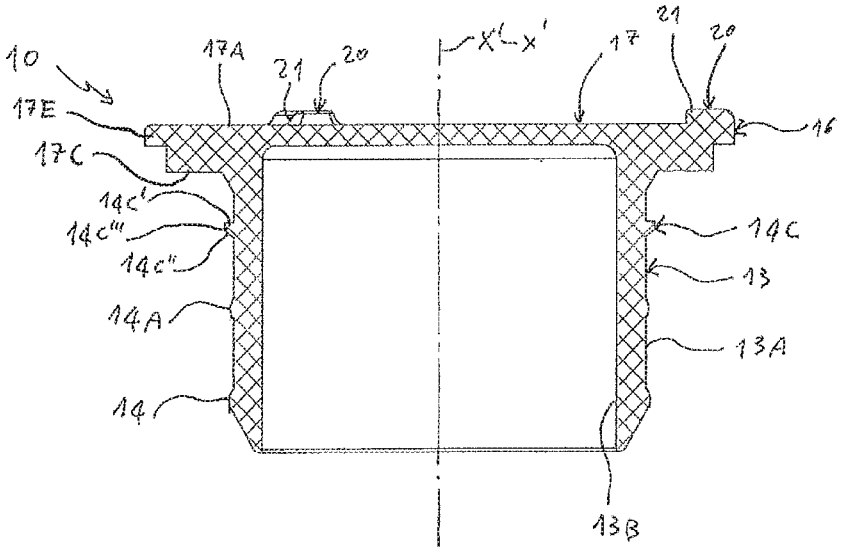
Figure 4:
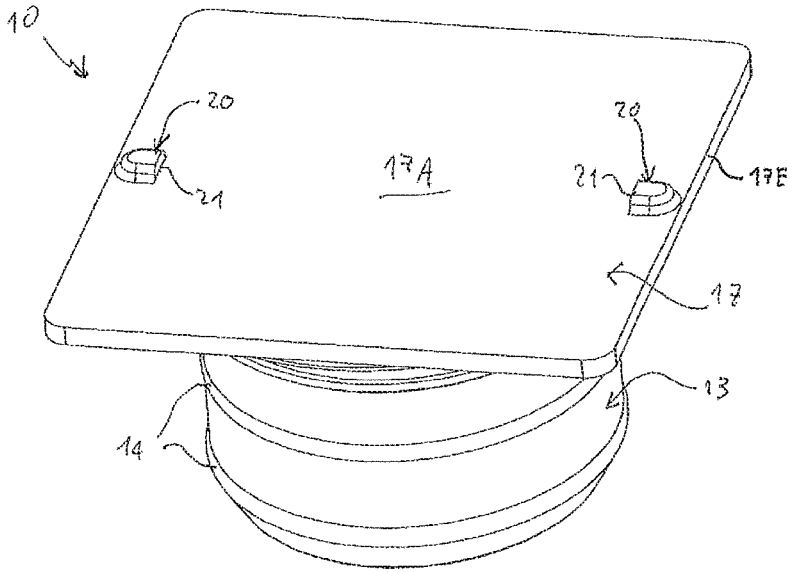
FIG. 4 is a perspective view of a third embodiment of a press-on cap of the present invention.

In the embodiment of FIGS. 3*a* and 3*b*, the protrusions 21 seamlessly extend from an outer limit 17E of the capping wall 17. Conversely, in the embodiment of FIGS. 2*a* and 2*b*, the protrusions 21 are spaced apart from the outer limit 17E of the capping wall 17.

In one aspect of the press-on cap 10, the material of which it is made is a polymeric material that can withstand a high-temperature sterilization cycle and/or a sterilization cycle that uses chemicals known to the skilled person.

It shall be noted that the high temperature of the sterilization cycle ranges from ninety-five degrees Celsius to one hundred degrees Celsius.

This will reliably prevent the formation of molds and microbial flora, as the sterilization cycle depends on the chemico-physical characteristics of the food product, and the more the latter is close to a neutral pH, the more likely a microbial contamination due to poor sterilization will occur.

This will advantageously afford sterilization of the outer surface 13A of the sleeve 13 as well as the parts of the press-on cap 10 that are exposed when the cap is irreversibly closingly coupled, irrespective of the pH value of the food product, and also regardless of the particular type of material that has been used to form the cap.

Preferably, the material that is used to form the press-on cap, for the latter to withstand the sterilization cycle with steam at the aforementioned temperatures, is nylon PA66 and similar resins.

Alternatively, polypropylene may be used to form the press-on cap 10.

Advantageously, the combination of the profile of the wall 17 (which seamlessly extends across the surface delimited by the rim 16) and the material of the press-on cap 10 can prevent the formation of molds.

In one aspect of the invention, the cap 10 comprises a single tubular sleeve 13, which is intended to fit into the mouth of the container.

Particularly, the single tubular sleeve 13 extends transverse, preferably orthogonal, to the capping wall.

In other words, no skirt or lip extends from the rim 16 to at least partially cover the exterior of the outer surface 13A of the tubular sleeve 13.

This affords safer and easier cleaning of the press-on cap 10, as the entire surface of the cap and/or the neck of the container, which is exposed to product contamination, can be directly washed with water and/or steam.

In one embodiment, not shown, the capping wall 17 may be connected to the rim 16 along a plane that is transverse to the capping wall 17.

Namely, this plane is substantially parallel to the axis of extension X'-X'.

Preferably, the press-on cap 10, the tubular sleeve 13, the neck 12 of the container 11 and the rim 16 have a circular plan shape.

Here, the diameter of the rim 16 of the press-on cap 10 has a greater diameter than the neck 12 (and the shoulder 14C), to thereby project from the tubular sleeve 13, and the tubular sleeve 13 has a greater diameter than the neck 12 at the sealing projections 14 and 14A, to such an extent as to ensure that the cap 10 will fit into the mouth of the neck and a tight fit may be obtained between the cap and the neck.

The present invention further relates to a method of closing a container. This method particularly comprises the step of attaching a dispensing head to the neck 12 of the above described hermetically sealable container 11. Then, a product to be stored is dispensed through the dispensing head. The dispensing head is later removed.

A press-on cap of irreversible type 10 is placed on the neck 12, as described above. Then a grip head is laid on the front surface 17A of the capping wall 17. Particularly, the protrusions 21 on the capping wall 17 are fitted into corresponding recesses (not shown) formed on the grip head. Advantageously, this ensures proper positioning of the grip head with respect to the cap 10.

A force is then applied to the cap 10 through the grip head, to thereby push the cap 10 toward the neck 12 of the container 11 and irreversibly lock it.

Those skilled in the art will obviously appreciate that a number of variants may be envisaged to the above described press-on cap and container having such press-on cap, still within the scope of the invention, as defined in the following claims.

The invention claimed is:

1. A system for capping a mouth of a container, the system comprising:

a press-on cap for irreversibly capping the mouth of the container, wherein the press-on cap is made of polymeric material able to withstand high-temperature sterilization and wherein the press-on cap comprises:

a tubular sleeve extending along an axis of extension and configured to be irreversibly locked to the mouth of the container;

a rim that radially projects out of the tubular sleeve at an end of the press-on cap;

a capping wall oriented transverse to the tubular sleeve and extending from the rim over a front surface delimited by the rim, wherein the front surface faces outwardly; and a plurality of protrusions, which extend out of the front surface;

wherein the front surface has a height variation relative to the rim across the front surface ranging from −1% to 1% of a characteristic dimension of the capping wall, wherein the protrusions are shaped complementary to a gripping head, and wherein the protrusions are configured to guide the gripping head during application of the press-on cap.

2. The system of claim 1, wherein the protrusions are arranged in a peripheral area of the front surface of the capping wall.

3. The system of claim 1, wherein the protrusions are angularly equally spaced relative to the axis of extension.

4. The system of claim 1, wherein the protrusions seamlessly extend from an outer limit of the capping wall.

5. The system of claim 1, wherein the capping wall has no notches or recesses.

6. The system of claim 1, wherein the capping wall is substantially flat.

7. The system of claim 1, wherein the front surface of the capping wall is concave or convex.

8. The system of claim 1, wherein the capping wall has a circular plan shape and the characteristic dimensions of the capping wall is defined by a diameter of the capping wall, or wherein the capping wall has a square plan shape and the characteristic dimensions of the capping wall is defined by a length of a side of the capping wall.

9. The system of claim 1, wherein the capping wall is connected to the rim through a first surface that is transverse to the capping wall.

10. The system of claim 1, wherein the tubular sleeve comprises a plurality of sealing projections, which radially jut out of the tubular sleeve.

11. The system of claim 1, wherein the tubular sleeve comprises a radially projecting shoulder, the radian projecting shoulder comprising:

a first portion, which extends in a direction orthogonal to the axis of extension;

a second portion, which extends transverse to the axis of extension; and a third portion, which connects the first portion with the second portion;

wherein the third portion extends in a direction parallel to the axis of extension.

12. The system of claim 1, wherein the polymeric material comprises nylon PA66 or similar resin with a melting point exceeding 160° C.

13. The system of claim 1, wherein the front surface of the capping wall is concave.

14. The system of claim 1, wherein the front surface of the capping wall is convex.

15. The system of claim 1, wherein the front surface of the capping wall is not flat.

16. A method for closing a mouth of a container, the method comprising:

providing the container;

dispensing a product into the container through the mouth of the container;

placing a press-on cap on the neck of the container, wherein the press-on cap is made of polymeric material able to withstand high-temperature sterilization and comprises a tubular sleeve extending along an axis of extension and configured to be irreversibly locked to the mouth of the container, a rim that radially projects out of the tubular sleeve at an end of the press-on cap, a capping wall oriented transverse to the tubular sleeve and extending from the rim over a front surface delimited by the rim, wherein the front surface faces outwardly, a plurality of protrusions, which extend out of the front surface, and wherein the front surface has a height variation relative to the rim across the front surface ranging from −1% to 1% of a characteristic dimension of the capping wall; and applying force on the press-on cap, using a gripping head in contact with the front surface of the capping wall in which the protrusions on the capping wall are inserted into corresponding recesses on the gripping head, to push the press-on cap toward the neck of the container and to irreversibly lock the press-on cap on the neck.

17. A system for capping a mouth of a container, the system comprising:

a press-on cap for reversibly and irreversibly capping the mouth of the container, wherein the press-on cap is made of polymeric material able to withstand high-temperature sterilization and wherein the press-on cap comprises:

a tubular sleeve extending along an axis of extension and configured to be irreversibly locked to the mouth of the container;

a rim that radially projects out of the tubular sleeve at an end of the press-on cap;

a capping wall oriented transverse to the tubular sleeve and extending from the rim over a front surface delimited by the ring, wherein the front surface faces outwardly; and a plurality of protrusions, which extend out of the front surface;

wherein the front surface has a height variation relative to the rim across the front surface ranging from −1% to 1% of a characteristic dimension of the capping wall, wherein the protrusions are shaped complementary to a gripping head, and wherein the protrusions are configured to guide the gripping head during application of the press-on cap.

18. The system of claim 17, wherein the tubular sleeve comprises a plurality of sealing projections, which radially jut out of the tubular sleeve, and wherein the sealing projections are configured for the reversibly capping of the mouth of the container.

19. The system of claim 17, wherein the tubular sleeve comprises a radially projecting shoulder, and wherein the radially projecting shoulder is configured for the irreversibly capping of the mouth of the container.

20. The system of claim 17, wherein the tubular sleeve comprises a plurality of sealing projections, which radially jut out of the tubular sleeve, wherein the sealing projections are configured for the reversibly capping of the mouth of the container, wherein the tubular sleeve further comprises a radially projecting shoulder, and wherein the radially projecting shoulder is configured for the irreversibly capping of the mouth of the container.

* * * * *